United States Patent [19]

Sayles

[11] 3,932,241

[45] Jan. 13, 1976

[54] PROPELLANTS BASED ON BIS[N-(TRINITROETHYL)NITRAMINO]ETHANE

[75] Inventor: David C. Sayles, Huntsville, Ala.

[73] Assignee: The United States of America as represented by the Secretary of the Army, Washington, D.C.

[22] Filed: July 6, 1970

[21] Appl. No.: 56,017

[52] U.S. Cl. ..... 149/19.3; 149/19.6; 149/19.91; 149/75; 149/88; 149/92

[51] Int. Cl.[2] ..... C06D 5/06

[58] Field of Search ..... 149/19, 76, 92, 109, 19.3, 149/19.6, 19.91, 75, 88

[56] References Cited

UNITED STATES PATENTS

| | | | |
|---|---|---|---|
| 2,481,283 | 9/1949 | Blomquist et al. | 149/92 X |
| 3,038,009 | 6/1962 | Schaffner | 149/92 X |
| 3,117,044 | 1/1964 | Sauer | 149/92 X |
| 3,255,059 | 6/1966 | Hamermesh et al. | 149/92 X |
| 3,389,026 | 6/1968 | Johnson | 149/19 |
| 3,476,622 | 11/1969 | Harada et al. | 149/19 |
| 3,586,552 | 6/1971 | Potts et al. | 149/19 |
| 3,804,683 | 4/1974 | Baldwin et al. | 149/92 X |

OTHER PUBLICATIONS

Grant, "Hackh's Chemical Dictionary," 4th Ed., p. 456 (1969).

*Primary Examiner*—Richard D. Lovering
*Assistant Examiner*—E. A. Miller
*Attorney, Agent, or Firm*—Nathan Edelberg; Robert P. Gibson; James T. Deaton

[57] ABSTRACT

Propellant compositions using bis[N-(trinitroethyl)nitramino]ethane as an oxidizer for smokeless propellants that additionally contain binder ingredients, crosslinking agent and other additives as desired.

10 Claims, No Drawings

PROPELLANTS BASED ON BIS[N-(TRINITROETHYL)NITRAMINO]ETHANE

BACKGROUND OF THE INVENTION

In solid propellants, the problem of smoke in the exhaust gases exists. This smoke is undesirable in the exhaust gases since this gives the enemy data for pin pointing the sites from which missiles are being fired. Smokeless type propellants containing both HMX (cyclotetramethylenetetranitroamine) and ammonium perchlorate have been used in propellants of this type. Acrylic prepolymers have been used in NF propellants containing ammonium perchlorate and HMX as the oxidizer. The techniques for preparing and formulating propellant compositions of these types is well known to those skilled in the art.

As an example of propellant compositions utilizing HMX as the oxidizer for the propellant, see U.S. Pat. No. 3,386,868. Other prior propellant compositions have used HMX and ammonium perchlorate as the oxidizer.

Even in view of the prior art, there still exists a need for a solid propellant with a minimum amount of smoke in the exhaust gases and with performance approaching that of solid propellants that have more smoke in the exhaust gases.

Accordingly, it is an object of this invention to provide a solid propellant composition that has a reduced amount of smoke in the exhaust gases thereof.

A further object of this invention is to provide an oxidizer that can be used instead of HMX or HMX and ammonium perchlorate in propellant formulations.

SUMMARY OF THE INVENTION

In accordance with this invention, it has been discovered that the compound bis[N-(trinitroethyl)nitramino]ethane or N,N'-bis(trinitroethyl)ethylenedinitroamine (BTNEEDNA) can be prepared by the condensation of ethylenedinitroamine with formaldehyde and nitroform and used as an oxidizer in propellant compositions to produce smokeless propellant. These compositions generally contain, in addition to the oxidizer which may be BTNEEDNA and/or ammonium perchlorate, binder such as an acrylate-acrylic acid copolymer with TVOPA, {1,2,3,-tris[1,2-bis(difluoroamino)ethoxy]-propane}, additive such as carbon black and a curing agent such as UNOX 221 (4,5-epoxycyclophexylmethyl4,5-epoxycyclohexylcarboxylate or a diepoxy dicyclohexyl carboxylate).

DESCRIPTION OF THE PREFERRED EMBODIMENT

It has been discovered that a more energetic smokeless propellant can be obtained by replacing HMX or HMX and ammonium perchlorate with BTNEEDNA.

The starting compound, ethylenedinitroamine, used in preparing BTNEEDNA was first synthesized in Germany before the turn of the century. BTNEEDNA is prepared by the condensation of ethylenedinitroamine with formaldehyde and nitroform as typified by the following equation:

$$O_2N.NH.CH_2.CH_2NH.NO_2 + 2CH_2O + HC(NO_2)3 \rightarrow (O_2N)_3C.CH_2.(O_2N)N.CH_2.CH_2.N-(NO_2).CH_2.C(NO_2)_3$$

The procedure for the synthesis of bis[N-(trinitromethyl)nitramino]ethane, N,N'-bis(trinitroethyl)ethylenedinitroamine or 3,6-diaza-1,1,1,3,6,8,8,8,-octanitrooctane involves going thru the dimethylolethylenedinitroamine in an almost-typical Mannich condensation. Ethylenedinitroamine (3g., 0.040 moles) is added to water (30 ml.), and 30% formaldehyde (30%, 4 ml.) solution is added. The mixture is heated until all of the ethylenedinitroamine has dissolved. The solution is then cooled to room temperature, and nitroform (15g., 0.1 moles) is added dropwise. After complete addition, the reaction mixture is allowed to stand overnight. The product which precipitates is filtered, washed in succession with water, alcohol and ether, and dried. The empirical formula for BTNEEDNA is $C_6H_8N_{10}O_{16}$ as compared to the formula for HMX which is $C_4H_8N_8O_8$. On an equal weight basis, BTNEEDNA contains 33 ⅓% more oxygen and 33 ⅓% less hydrogen. As a result, a theoretical 25–45% more effective oxidizer in a propellant formulation results.

The oxidizer BTNEEDNA as a replacement for HMX is illustrated in Table I. Composition A is a formulation containing HMX and ammonium perchlorate as the oxidizers for an NF-propellant system. Composition B is a formulation in which BTNEEDNA has replaced the HMX in an otherwise identical formulation. The AP included in Composition A is to lower the pressure exponent and provide a measure of burning rate control.

TABLE I

EFFECT OF SUBSTITUTING BTNEEDNA FOR HMX IN AN EANF-PROPELLANT FORMULATION

| INGREDIENT | COMPOSITION A | COMPOSITION B |
|---|---|---|
| Ethyl acrylate-acrylic acid (95/5) | 4.63 | 4.63 |
| 1,2,3-tris[1,2-bis(difluoroamino)-ethoxy]propane | 25.68 | 25.68 |
| HMX | 48.56 | 0.0 |
| bis[N-(trinitroethyl)nitramino]-ethane | 0.0 | 48.56 |
| Ammonium Perchlorate | 19.21 | 19.21 |
| UNOX 221 | 1.44 | 1.44 |
| Carbon Black | 0.48 | 0.48 |
| THEORETICAL PERFORMANCE | | |
| $C^*$ (fps) | 5152 | 5265 |
| $C_F$ | 1.562 | 1.578 |
| $I_{sp}$ (lb-sec/lb) | 250.1 | 258.2 |
| EXHAUST GAS COMPOSITION (MOLE FRACTIONS) | | |
| $CH_4$ | 0.00001 | — |
| CO | 0.25038 | 0.22347 |
| $CO_2$ | 0.08732 | 0.14066 |
| H | 0.0 | 0.00001 |
| HCl | 0.03747 | 0.04165 |
| HF | 0.14627 | 0.16256 |
| $H_2$ | 0.18310 | 0.09145 |
| $H_2O$ | 0.09000 | 0.14900 |
| $NH_3$ | 0.0001 | — |
| $N_2$ | 0.20545 | 0.19120 |

Of particular interest in the above propellant is the fact that the specific impulse improvement which is effected by such a substitution is 8 lbf-sec/lbm — a significant improvement. BTNEEDNA is also a better oxidizer as evident by the lower CO and $H_2$ content. This means more efficient combustion and less afterburning or plume combustion.

The oxidizer BTNEEDNA as a replacement for HMX and ammonium perchlorate is illustrated in Table II. Composition A is a formulation containing HMX and ammonium perchlorate as the oxidizer for an NF-propellant system. Composition B is a formulation in which BTNEEDNA has replaced both the HMX and the ammonium perchlorate in an otherwise identical formulation.

TABLE II

| EFFECT OF SUBSTITUTION BTNEEDNA FOR HMX AND AP IN AN EANF PROPELLANT FORMULATION INGREDIENT | COMPOSITION A | B |
|---|---|---|
| | % (by wt) | |
| Ethyl acrylate-acrylic acid (95/5) | 4.63 | 4.63 |
| 1,2,3-tris[1,2-bis(difluoroamino-ethoxy)]propane | 25.68 | 25.68 |
| bis[N-(trinitroethyl)nitramino]ethane | — | 67.77 |
| UNOX 221. | 1.44 | 1.44 |
| Carbon Black | 0.48 | 0.48 |
| HMX | 48.56 | — |
| Ammonium Perchlorate | 19.21 | — |
| THEORETICAL PERFORMANCE | | |
| $C^*$ (fps) | 5152 | 5283 |
| $C_F$ | 1.562 | 1.569 |
| $I_{sp}$ (lbf-sec/lbm) | 250. | 258. |

As can be seen, the results in Table I are based upon the replacement of only the HMX with the BTNEEDNA is a representative EANF(inert-NF) propellant formulation which contains some ammonium perchlorate. The ammonium perchlorate serves as a means of lowering the pressure exponent. A side benefit that the ammonium perchlorate provides is a means of varying the burning rate by varying the particle size of the ammonium perchlorate.

When both the HMX and ammonium perchlorate are replaced with the BTNEEDNA in a formulation as illustrated in Table II, there is no appreciable change in the specific impulse value as compared to the formulation illustrated in Table I where the BTNEEDNA only is substituted for the HMX. Thus, replacement of either HMX or both HMX and ammonium perchlorate with BTNEEDNA result in propellants having specific impulse values which are 8 lbf-sec/lbm better than an EANF formulation containing HMX and ammonium perchlorate as oxidizers.

The oxidizer BTNEEDNA may vary from 20 to 80 weight percent in the propellant, depending upon the particular propellant formulation, and the oxidizer, ammonium perchlorate when used, may vary from about 5 to about 50 weight percent.

The plasticizer and binder used with the oxidizer BTNEEDNA may be other than those illustrated in the propellant formulations set forth above. With the prepolymer binder mix of acrylate to acrylic acid, it is preferred that a ratio of acrylate to acrylic acid of 95/5 be used, but the ratio of selected acrylate to acrylic acid in the prepolymer may vary from about 90/10 to about 96/4. The acrylate used may be selected for example from methyl acrylate, 2-ethylhexyl acrylate, petrin acrylate, butyl acrylate, ethyl acrylate, etc.

The plasticizer ingredient, TVOPA, used in this invention is present with the prepolymer of acrylate to acrylic acid in a preferred ratio of about 5 to 1, and this ratio may vary from about 3 to 1 to about 6 to 1 when the two are used together. The amount of plasticizer present in the propellant formulation is preferably about 20 to 35 weight percent, but may vary from 0 to 40 weight percent.

TVOPA may be synthesized by reacting tris(vinoxy)-propane (prepared in accordance with U.S. Pat. No. 2,969,400) with tetrafluorohydrazine. TVOPA contains two high energy difluoroamino groups, $NF_2$, added to each of the three vinoxy groups of the starting compound, tris(vinoxy)propane. The reaction of tetrafluorohydrazine with tris(vinoxy)propane to form TVOPA is conducted under pressure in the range of 500 mm of mercury up to about 600 psig and temperature range of 0° to 120°C. The reaction is conducted in the presence of an inert volatile organic solvent, preferably one that is a suitable solvent for both the TVOPA as well as the reactants. Aromatic and aliphatic hydrocarbons, chlorinated hydrocarbons, ethers and ketones may be employed as the solvent. Typical solvents include diethyl ether, dipropyl ether, pentane, hexane, chloroform, carbon tetrachloride, methylene chloride, benzene, toluene, xylene, and acetone.

Conventional curing agents such as UNOX 221 and other conventional curing agents may be used to cure the binder. Other additives in trace amounts as desired for the particular propellant may be used such as stabilizers, ballistic modifiers, processing aids and the like.

Even though the oxidizer, BTNEEDNA, has been illustrated in an inert-NF propellant formulation, the oxidizer may be used in propellant formulations containing no NF groups of TVOPA in the formulations.

I claim:

1. A propellant composition comprising; an oxidizer including bis[N-(trinitroethyl)nitramino]ethane, an acrylate-acrylic acid binder, and a curing agent, said acrylate-acrylic acid being present in a ratio of acrylate to acrylic acid in an amount of about 90/10 to about 96/4.

2. The propellant composition of claim 1, wherein said oxidizer also includes ammonium perchlorate.

3. The propellant composition of claim 1, wherein said curing agent is diepoxy dicyclohexyl carboxylate, and said propellant composition further comprises a plasticizer, 1,2,3-tris[1,2-bis(difluoroamino)ethoxy]-propane.

4. The propellant composition of claim 1, wherein said binder consists of a copolymer of acrylate-acrylic acid in an amount up to about 25 weight percent of the propellant composition.

5. The propellant composition of claim 1, wherein said curing agent is diepoxy dicyclohexyl carboxylate, and said propellant composition further comprises a plasticizer, 1,2,3-tris[1,2-bis(difluoroamino)ethoxy]-propane, said binder to plasticizer being present in a ratio of about 1 to 5.

6. The propellant composition of claim 5, wherein said plasticizer and binder constitute from about 25 to about 35 weight percent of the propellant composition, and said oxidizer constitutes from about 65 to about 75 weight percent of said propellant composition.

7. The propellant composition of claim 6, wherein said acrylate-acrylic acid is ethyl acrylate-acrylic acid.

8. The propellant composition of claim 1, wherein said oxidizer consists of ammonium perchlorate of about 19.2 weight percent of the propellant composition and bis[N-(trinitroethyl)nitramino]ethane of about about 48.6 weight percent of the propellant composition, said curing agent consists of diepoxy dicyclohexyl carboxylate of about 1.4 weight present of propellant composition, and the propellant composition contains the additional ingredients carbon black in an amount of about 0.5 weight percent of the propellant composition, and a plasticizer, 1,2,3-tris[1,2-bis(difluoroamino)ethoxy]propane, of about 25.7 weight percent of the propellant composition, the remainder of said propellant composition being binder.

9. The propellant composition of claim 1, wherein said oxidizer consists of said bis[N-(trinitroethyl)nitramino]ethane in an amount of about 67.8 weight percent of the propellant composition, said curing agent is diepoxy dicyclohexyl carboxylate of about 1.4 weight percent of the propellant composition, and said propellant also contains carbon black in an amount of about 0.5 weight percent and a plasticizer, 1,2,3-tris[1,2-bis(difluoroamino)ethoxy]propane, of about 25.7 weight percent of the propellant composition, the remainder of said propellant composition being binder.

10. The propellant composition of claim 1, wherein said bis[N-(trinitroethyl)nitramino]ethane constitutes from about 50 to about 75 weight percent of the propellant composition.

* * * * *